United States Patent [19]

Theurer et al.

[11] Patent Number: 5,052,132

[45] Date of Patent: Oct. 1, 1991

[54] BALLAST DISTRIBUTING AND PLANING MACHINE

[75] Inventors: Josef Theurer, Vienna; Wörgötter, Linz, both of Austria

[73] Assignee: Franz Plasser Bahnbaumaschinen-Industriegesellschaft m.b.H., Vienna, Austria

[21] Appl. No.: 666,722

[22] Filed: Mar. 8, 1991

[30] Foreign Application Priority Data

Mar. 21, 1990 [AT] Austria ..... 668/90

[51] Int. Cl.[5] ..... E02F 5/22

[52] U.S. Cl. ..... 37/104; 104/279

[58] Field of Search ..... 37/104, 105, 106, 107; 104/2, 279; 171/16

[56] References Cited

U.S. PATENT DOCUMENTS

| | | | |
|---|---|---|---|
| 3,612,184 | 10/1971 | Plasser et al. . | |
| 4,227,324 | 10/1980 | Theurer | 37/104 |
| 4,236,452 | 12/1980 | Theurer et al. | 37/104 X |
| 4,635,664 | 1/1987 | Theurer et al. | 37/107 X |
| 4,770,104 | 9/1988 | Theurer | 37/104 X |
| 4,794,862 | 1/1989 | Theurer | 37/104 X |
| 4,835,887 | 6/1989 | Theurer | 37/104 |
| 4,967,847 | 11/1990 | Whitaker, Jr. | 37/104 X |

FOREIGN PATENT DOCUMENTS

| | | |
|---|---|---|
| 1169721 | 11/1966 | United Kingdom . |
| 1541038 | 3/1976 | United Kingdom . |

*Primary Examiner*—Dennis L. Taylor
*Assistant Examiner*—J. Russell McBee
*Attorney, Agent, or Firm*—Collard, Roe & Galgano

[57] ABSTRACT

A ballast distributing and planing machine comprises an elongated machine frame supported on the track by undercarriages for mobility along the track in an operating direction, a ballast broom extending transversly across the track and mounted on the machine frame at a rear end thereof in the operating direction, and a ballast plow arrangement mounted on the machine frame. A ballast storage container is mounted on the machine frame and has at least one discharge opening enabling ballast stored in the container to be discharged onto the track, and a ballast discharge conveyor band is mounted immediately below each discharge opening and is arranged to close the opening, each conveyor band having a drive for moving the conveyor band in a conveying direction.

16 Claims, 3 Drawing Sheets

Fig. 2
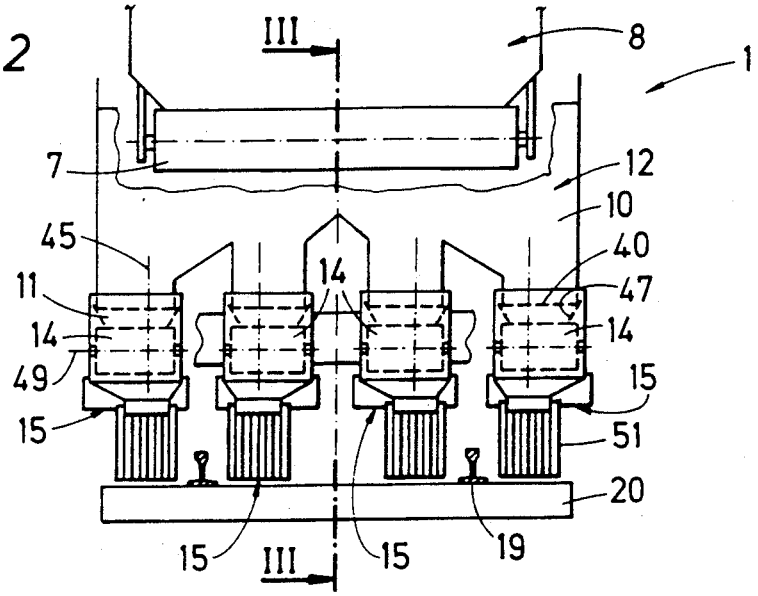
Fig. 3
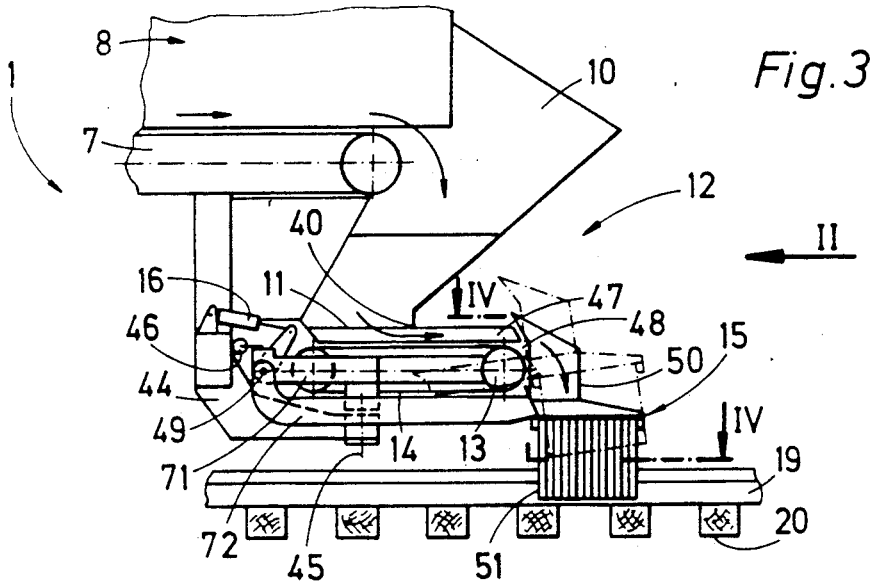
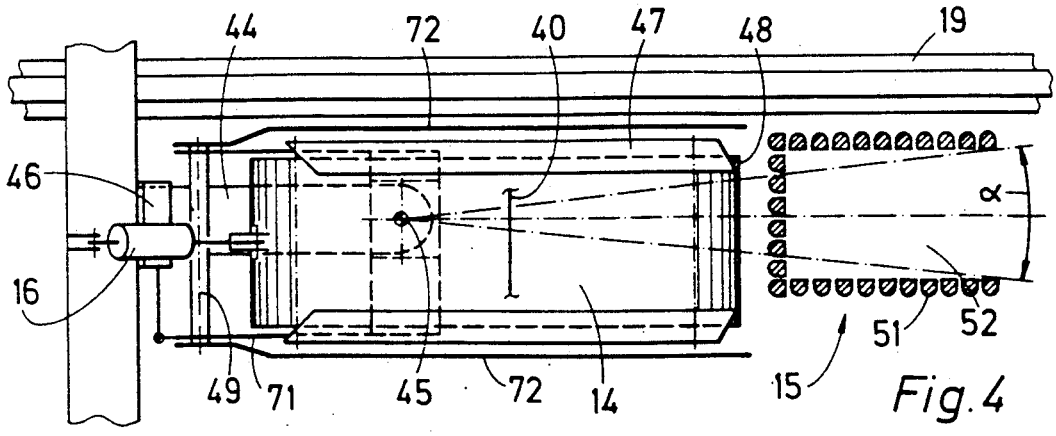
Fig. 4

BALLAST DISTRIBUTING AND PLANING MACHINE

BACKGROUND OF THE INVENTION

1. Field of the Invention

The present invention relates to a machine for distributing and planing ballast supporting a railroad track comprising two rails fastened to ties, each rail having a gage side and a field side, which comprises an elongated machine frame supported on the track by undercarriages for mobility along the track in an operating direction, a ballast broom extending transversely across the track and mounted on the machine frame at a rear end thereof in the operating direction, a ballast plow arrangement mounted on the machine frame forwardly of the ballast broom in the operating direction, and a ballast storage container mounted on the machine frame and having at least one discharge opening enabling ballast stored in the container to be discharged onto the track.

2. Description of the Prior Art

A ballast distributing and planing machine of this type has been disclosed in U.S. Pat. No. 3,612,184, dated Oct. 12, 1971. The machine carries a plow for shaping and planing the ballast, and the ballast storage container receives ballast swept up from the ballast bed for storing therein and redistributes the stored ballast in desired areas of the track through discharge openings in the bottom of the container. The discharge openings may be selectively opened and closed by pivotal closures operated by hydraulic drives. This arrangement is not capable of quickly responding to different ballasting conditions since further ballast continues to flow out of the openings while the pivotal closures are closed. Furthermore, any ballast jammed in the opening by the pivoting closure as it closes the opening will prevent complete closing and may also interfere with the subsequent opening thereof.

British patent No. 1,169,721, published Nov. 5, 1969, discloses a mobile ballast surfacing machine with a rotary broom directing swept-up ballast into a storage container. The discharge openings of the ballast storage container may be selectively opened and closed by hydraulically operated arcuate slides. This arrangement suffers from the same disadvantages.

British patent No. 1,541,038, published Feb. 21, 1979, discloses a mobile ballast cleaning machine equipped with an arrangement for redistributing the cleaned ballast to the track. The cleaned ballast is stored in a container and may be selectively redistributed therefrom through discharge openings. The ballast flow through the openings is controlled by hydraulically operated pivotal shutters, and the closing movement is made more difficult because the shutters are subjected to the entire weight of the ballast flowing out of the container through the shuttered opening and the closing force must counteract this weight.

SUMMARY OF THE INVENTION

It is the primary object of this invention to improve a ballast distributing and planing machine of the first-described type in a manner permitting the ballast flow from the storage container to the track to be more accurately controlled and to be instantly interrupted.

The above and other objects are accomplished in such a machine according to the invention by mounting a ballast discharge conveyor band immediately below each discharge opening and arranged to close the opening, each conveyor band having a drive for moving the conveyor band in a conveying direction. This provides a simple closing structure for the discharge opening while advantageously enabling the stored ballast to be discharged by the moving conveyor band in exactly metered amounts.

By de-activating the conveyor band drive, the movement of the conveyor band may be stopped instantly, thus promptly and effectively discontinuing further delivery of ballast to certain track regions, such as frogs in switches. By mounting the conveyor band immediately below the discharge opening of the ballast storage container, it operates as an effective closure when the conveyor band does not move and thus prevents any outflow of stored ballast from the container. Similarly, the flow of ballast may be started at any desired point simply by starting the drive. In this manner, no trouble-prone sliding or pivoting closures are needed.

Preferably, each conveyor band extends in the longitudinal direction of the elongated machine frame. In this manner, successive cribs may be filled with ballast continuously across a width corresponding to the width of the conveyor band as the machine advances along the track. Several conveyor bands may be mounted adjacent each other across the crib width and selected ones may be moved or stopped, depending on which area of the crib is to be supplied with ballast.

According to one preferred embodiment, the ballast storage container has four discharge openings, and four ballast discharge conveyor bands mounted immediately below the discharge openings extend respectively along the gage and field sides of the two track rails, each conveyor band being pivotal about a vertical axis extending perpendicularly to the track, and a respective pivoting drive is connected to each conveyor band. With this arrangement, it is possible to pivot a selected conveyor band away from a rail branching off the main track in a switch area to prevent ballast from being dumped over the branch rail and to enable ballast to be supplied to the cribs uniformly in switches. If the vertical axes are substantially centered with respect to the respective ballast discharge openings wherebelow the pivotal conveyor bands are mounted, the opening will remain covered by the conveyor band even when it has been laterally pivoted.

In accordance with a preferred feature of the present invention, each conveyor band has substantially double the length of the discharge opening wherebelow it is mounted, measured in the longitudinal direction of the machine frame. In this way, the projecting discharge end of the conveyor band can be laterally pivoted a sufficient distance from its normal position to enable the conveyor band to operate effectively in switches.

Each conveyor band has a ballast supporting surface facing the discharge opening wherebelow it is mounted, the ballast supporting surface having opposite sides extending in the longitudinal direction of the machine frame, and according to a preferred embodiment, opposite ballast guide elements extend along the opposite sides of the ballast supporting conveyor band surface in the longitudinal direction of the machine frame, the ballast guide elements being arranged in V-formation to form a funnel leading from the discharge opening to the ballast supporting conveyor band surface and having upper edges extending parallel to the surface and above, and outwardly of, the discharge opening. This prevents the stored ballast from overflowing the conveyor band uncontrollably along its opposite sides and to fall into the cribs.

According to another preferred feature, a chute-like ballast distributing device is arranged to receive ballast from the conveyor band discharge end, the ballast distributing device being pivotal about a horizontal axis extending transversely to the longitudinal direction of the elongated machine frame, and a drive is connected to the pivotal ballast distributing device for vertically adjusting the device between an operating and a raised position. Such a ballast distributing device dependably and accurately directs the discharged ballast to desired track areas. During transit or if a track obstacle is encountered, the ballast distributing device may be readily raised out of its operating position.

The chute-like ballast distributing device preferably comprises elastic wiper elements at a lower end of the device, the wiper elements extending vertically in the operating position of the pivotal ballast distributing device and defining a section whose forward end is open in the operating direction. In this way, any ballast thrown on the ties will be automatically engaged by the wiper elements and swept into the adjacent cribs, particularly if the elastic wiper elements have free lower ends extending substantially to the ties in the operating position of the pivotal ballast distributing device. The elasticity of the wiper elements prevents jamming of ballast between the ties and the ballast distributing device.

According to yet another preferred feature of this invention, a baffle plate is arranged between the conveyor band discharge end and an upper end of the chute-like ballast distributing device, the baffle plate defining an angle with the plane defined by the conveyor band. This delimits the parabolic discharge path of the ballast to a small, fixed distance from the discharge end of the conveyor band, regardless of the conveyance speed thereof.

The ballast storage container may have one discharge opening per rail, each ballast discharge conveyor band mounted immediately below each discharge opening having a discharge end, and a respective chute-like ballast distributing device is arranged to receive ballast from the conveyor band discharge end, the ballast distributing device having discharge openings extending respectively along the gage and field sides of the two track rails. This simple and robust arrangement enables the ballast to be delivered in a desirable manner in ribbons along the track rails, without any other structures.

If a conveyor extends along a bottom portion of the ballast storage container and each discharge opening is arranged below the conveyor discharge end for receiving ballast therefrom, the stored ballast will be conveyed flawlessly to each discharge opening so that the discharge conveyor bands will receive an uninterrupted and uniform flow of the ballast.

According to still another advantageous embodiment, the ballast storage container has a single discharge opening extending along a bottom portion of the container and a single conveyor band is arranged immediately below the single discharge opening to close the opening. This constitutes the simplest structure providing the first-named advantages of the invention and may be used with an elongated ballast storage container of large storage volume. Ballast distributing chutes may be arranged below the conveyor band discharge end for receiving ballast therefrom, the flow of ballast to the chutes being controlled, for example, by the conveyance speed of the conveyor band or by controlled valves.

If two conveyor bands are arranged immediately below a single discharge opening extending along a bottom portion of the container, the conveyance speed of the two conveyors may be selectively controlled so that different amounts of ballast are discharged from the conveyor bands without the need for distributing chutes or like devices. The two conveyor bands extend substantially parallel to, and adjacent each other, defining a small gap therebetween, and a cover element extends over the gap whereby the two conveyor bands and the cover element close the opening.

If the ballast storage container has a single discharge opening along a bottom portion of the container and at least one of the conveyor bands is arranged immediately below the single discharge opening to close the opening, each conveyor band having a discharge end, and a ballast discharge conveyor extends in the longitudinal direction of the elongated machine frame and is arranged to receive ballast stored in the container and discharged at the conveyor band discharge end, the storage container may be unloaded without difficulty whenever required.

BRIEF DESCRIPTION OF THE DRAWING

The above and other objects, advantages and features of the present invention will become more apparent from the following detailed description of certain now preferred embodiments thereof, taken in conjunction with the somewhat schematic accompanying drawing wherein

FIG. 2 is an enlarged and simplified end view of the ballast distributing arrangement of FIG. 1, as seen in the direction of arrow II in FIG. 3;

FIG. 3 is a section along line III—III of FIG. 2;

FIG. 4 is an enlarged fragmentary top view of the ballast distributing arrangement, taken along line IV—IV in FIG. 3;

DETAILED DESCRIPTION OF PREFERRED EMBODIMENTS

Figure 1:
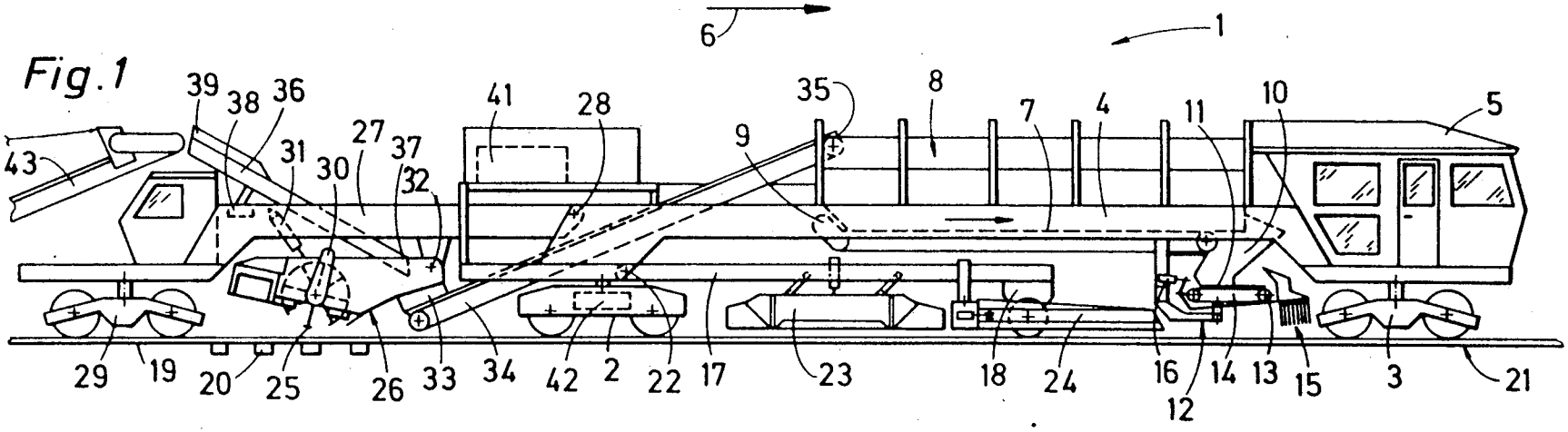
FIG. 1 is a side elevational view of a mobile ballast distributing and planing machine incorporating one embodiment of this invention.

Referring now to the drawing, wherein like reference numerals designate like parts operating in a like manner in all figures, FIG. 1 shows machine 1 for distributing and planing ballast supporting railroad track 21 comprising two rails 19 fastened to ties 20, each rail having a gage side and a field side. Machine 1 comprises elongated machine frame 4 supported on the track by undercarriage 2, 3 for mobility along track 21 in an operating direction indicated by arrow 6. Operator's cab 5 is mounted on the front end of the machine frame, and rotary ballast broom 25 extending transversely across the track is mounted on machine frame 4 at a rear end thereof in the operating direction. The ballast broom is part of ballast sweeping arrangement 26 vertically adjustably mounted on carrier frame 27 extending in the longitudinal direction of elongated machine frame 4 and having a leading end linked at 28 to the rear end of the machine frame while its rear end is supported on track 21 by undercarriage 29. Universal coupling 28 links the carrier frame to the machine frame so that carrier frame 27 may be pivoted about axes extending transversely as well as vertically to the longitudinal direction of elongated machine frame 4. Broom 25 has radially extending, flexible sweeping elements and is rotatable by drive 30. Hydraulic drive 31 connects ballast sweeping arrangement 26 to carrier frame 27 for vertical adjustment of the broom, which is pivoted to a bracket downwardly projecting from carrier frame 27 for pivoting about horizontal axis 32 extending transversely to the carrier frame. Broom 25 is mounted in a housing and, upon rotation thereof in a counter-clockwise direction, sweeps ballast engaged thereby through the housing into chute 33, which discharges the swept-up ballast onto the input end of ascending conveyor 34 which conveys it to output end 35 whence the ballast is thrown into ballast storage container 8.

Downwardly inclined gutter 36 is mounted on carrier frame 27 above ballast broom 25 and extends in the longitudinal direction of the carrier frame from rear input end 39 to forward output end 37 which extends into the broom housing to deliver any required additional ballast into chute 33. When a long track section is surfaced with continuously advancing machine 1 and more ballast is required than is supplied to container 8 by ballast sweeping arrangement 26, additional ballast stored in a box car following machine 1 is conveyed by conveyor 43 to input end 39 of gutter 36, the gutter being vibrated by vibrator 38 to move the ballast down the gutter into chute 33 whence it is conveyed into ballast storage container 8.

Another operator's cab is mounted on carrier frame 27 below gutter input end 39 for controlling the operation of ballast supply gutter 36 and ballast sweeping arrangement 26 Central power plant 41 supplies power to all operating drives of machine 1, including drive 42 for advancing the machine along the track.

Machine 1 further comprises a ballast plow arrangement mounted on the machine frame in an upwardly recessed portion thereof between undercarriages 2, 3. The illustrated plow arrangement includes elongated carrier frame 17 extending in the longitudinal direction of elongated machine frame 4. Carrier frame 17 has a leading end supported on track 21 by undercarriage 18 and trailing end 22 linked to machine frame 4. Central ballast plow 23 is vertically adjustably mounted on carrier frame 17 between undercarriage 18 and pivot 22 for planing the portion of the ballast bed between track rails 19, and shoulder plows 24 are vertically and laterally adjustably mounted on the carrier frame.

Ballast storage container 8 is mounted on the machine frame and has at least one discharge opening 11 enabling ballast stored in the container to be discharged onto the track. Ballast discharge conveyor band 14 is mounted immediately below each discharge opening 11 and is arranged to close the opening. Each conveyor band has a drive 13 for moving the conveyor band in a conveying direction. As shown, each conveyor band 11 extends in the longitudinal direction of the elongated machine frame.

Ballast distributing arrangement 12 is more particularly shown in FIGS. 2 to 4. As illustrated, ballast storage container 8 has four discharge openings 11 and four ballast discharge conveyor bands 14 mounted immediately below the discharge openings, the conveyor bands extending respectively along the gage and field sides of the two track rails 19. In the illustrated embodiment, the ballast storage container has, instead of a fixed bottom, a bottom conveyor 7 extending along a bottom portion of the ballast storage container and moved by drive 9 in the longitudinal direction of elongated machine frame 4, with a discharge end leading in the operating direction. Discharge chutes 10 define discharge openings 11 below the conveyor discharge end for receiving ballast therefrom and distributing it at the field and gage sides of rails 19 at the points of intersection of the rails and ties 20 where track 21 is supported on the ballast bed.

As best shown in FIGS. 2 to 4, a respective chute-like ballast distributing device 15 is arranged to receive ballast from discharge end 48 of each discharge conveyor band 14, the ballast distributing device being pivotal about horizontal axis 49 extending transversely to the longitudinal direction of elongated machine frame 4, and respective drive 16 is connected to each pivotal ballast distributing device 15 for vertically adjusting the device between an operating (FIG. 3) and a raised (FIG. 4) position. During operation, bottom conveyor 7 will convey the ballast stored in container 8 to discharge chutes 10 and through openings 11 onto discharge conveyor bands 14. Each conveyor band has a carrier body 71 suspended on machine frame 4 by bracket 44 and is pivotal about vertical axis 45 extending perpendicularly to track 21, respective pivoting drive 46 being connected to each conveyor band carrier body. Each chute-like ballast distributing device 15 has a carrier body 72 which is pivotally mounted on carrier body 71 of associated conveyor band 14. Vertical axes 45 are substantially centered in the longitudinal direction with respect to respective ballast discharge openings 11 wherebelow pivotal conveyor bands 14 are mounted. As illustrated, each conveyor band has substantially double the length of the discharge opening wherebelow it is mounted, measured in the longitudinal direction of the machine frame.

Each conveyor band 14 has a ballast supporting surface facing discharge opening 11 wherebelow it is mounted, the ballast supporting surface having opposite sides extending in the longitudinal direction of the machine frame, and, in the illustrated embodiment, ballast distributing device 12 further comprises opposite ballast guide elements 47 extending along the opposite sides of the ballast supporting conveyor band surface in the longitudinal direction of the machine frame. Ballast guide elements 47 are arranged in V-formation to form a funnel leading from discharge opening 11 to the ballast supporting conveyor band surface and having upper edges extending parallel to the surface and above, and outwardly of, the discharge opening. This will prevent ballast on discharge conveyor bands 14 from overflowing.

Chute-like ballast distributing device 15 comprises elastic wiper elements 51 at a lower end of the device, the wiper elements extending vertically in the operating position of the pivotal ballast distributing device and defining section 52 whose forward end is open in the operating direction (see FIG. 4). Elastic wiper elements 51 have free lower ends extending substantially to ties 20 in the operating position of pivotal ballast distributing device 15 so that they will engage ballast lying on the ties and will distribute the ballast within open section 52 to the adjacent crib. Baffle plate 50 is arranged between conveyor band discharge end 48 and an upper end of chute-like ballast distributing device 15, the baffle plate defining an angle with the plane defined by conveyor band 14.

FIG. 4 illustrates a pivoting range $\alpha$ about vertical axis 45 for ballast distributing device 15 at each aside of rail 19 so that the ballast within open section 52 may be distributed to the desired point.

Before ballast distributing and planing machine 1 is put into operation, ballast storage container 8 is filled with ballast, for example by conveying ballast from a silo car by means of conveyor 43 into vibrating gutter 36 whence it is conveyed through chute 33 onto conveyor 34 which moves it into container 8. Some empty space is left in the container so that it may receive any additional ballast swept up by broom 25 during the operation of the machine.

In operation, rotary ballast broom 25 and ballast plows 23, 24 are lowered into their operating positions for suitably shaping the ballast bed and sweep up any plowed ballast as machine 1 advances continuously along track 21 in the operating direction indicated by arrow 6. In track sections wherein track 21 does not have enough ballast, ballast distributing device will supply additional ballast to the track. For this purpose, the operator in cab 5 will actuate drives 13 of respective ballast discharge conveyor bands 14 and control their conveying speed in dependence on local requirements. When the conveyor bands are stopped, they serve as closures over their associated discharge openings 11 so that no ballast will flow out of the respective openings. This control of the ballast delivery to the track is effective instantaneously. The outflow of ballast from discharge chute 10 for discharge by conveyor band 14 is assured by a small spacing of leading discharge opening edge 40 from subtending conveyor band 14, edge 40 extending transversely to the longitudinal direction of elongated machine frame 4. When conveyor band 14 is driven to convey the outflowing ballast to discharge end 48 whence baffle plate 50 directs it into chute-like ballast distributing device 15, elastic wiper elements 51 will force any ballast lying on the ties as well as the ballast coming from container 8 into the cribs. Additional stored ballast is conveyed to discharge chutes 10 by actuating drive 9 of bottom conveyor 7 in the ballast storage container.

When ballast distributing and planing machine 1 reaches a switch or a branch track or if certain track points at the shoulders require additional ballast, a respective discharge conveyor band 14 is pivoted by drive 46 about axis 45 to direct the outflowing ballast to the desired areas alongside track 21. To avoid track obstacles encountered along the continuous advance of the machine and at the end of the operation, drive 16 is actuated to raise ballast distributing device 15 into a rest position, this drive actuation automatically triggering the stoppage of drive 13. If additional ballast is required during operation along a long track section, such ballast may be supplied to ballast storage container 8 during the operation of the machine in the same manner as before the operation thereof.

Figure 5:
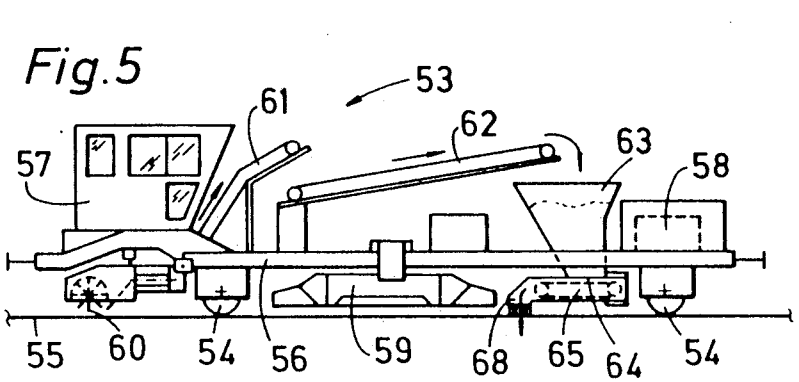
FIG. 5 is a side elevational view of a ballast plow incorporating a modified embodiment of this invention.

Ballast distributing and planing machine 53 shown in FIG. 5 comprises machine frame 56 mounted for mobility along track rails 55 on undercarriages 54. The rear end of the machine frame carries operator's cab 57 and central power plant 58 is mounted on a front end of the machine frame for supplying power to the operating drives of the machine. Ballast plow arrangement 59 is vertically adjustably mounted on machine frame 56 between the undercarriages and ballast broom 60 is vertically adjustably mounted on the rear end of the machine frame. Ascending conveyor 61 conveys any swept-up ballast from broom 60 to conveyor 62 which delivers the conveyed ballast to ballast storage container 63. The ballast storage container has one funnel-shaped discharge opening 64 per rail 55.

Figure 7:
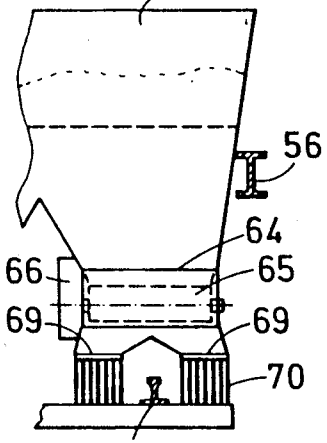
FIG. 7 is a fragmentary end view of the arrangement of FIG. 5, seen in the direction of arrow VII.
Figure 6:
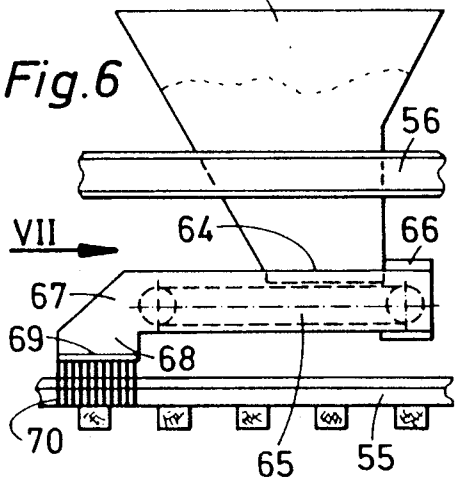
FIG. 6 is an enlarged fragmentary side view showing the ballast distributing arrangement of FIG. 5.

As shown in FIGS. 6 and 7, ballast storage container 63 has one discharge opening 64 per rail 55 and two ballast discharge conveyor bands 65 are mounted immediately below the discharge openings, each conveyor band being driven by drive 66 and having a discharge end 67. Chute-like ballast distributing device 68 is arranged to receive ballast from the conveyor band discharge end, the ballast distributing device having discharge openings 69, 69 extending respectively along the gage and field sides of the two track rails. The lower ends of the ballast distributing devices are equipped with elastic wiper elements 70 projecting downwardly from discharge openings 69, and they operate in a manner similar to that described hereinabove.

Figure 8:
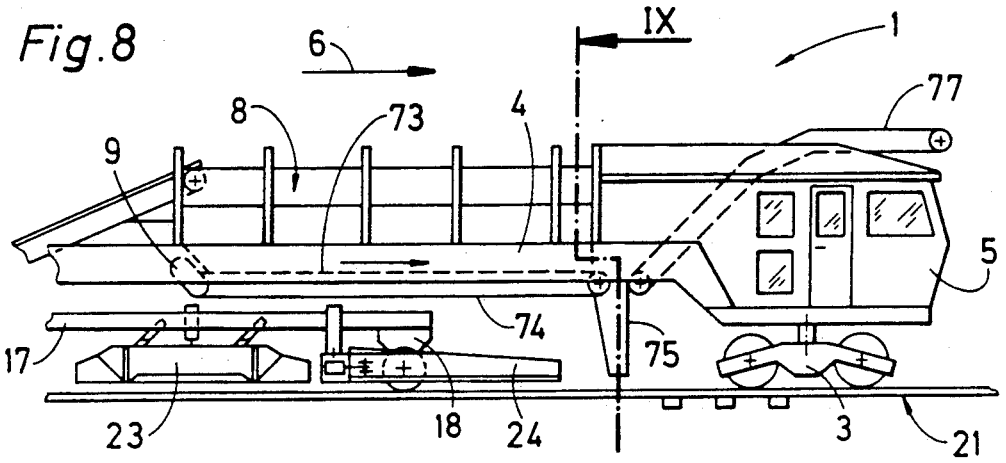
FIG. 8 is a fragmentary side elevational view of a machine incorporating yet another embodiment of the ballast distributing arrangement.
Figure 9:
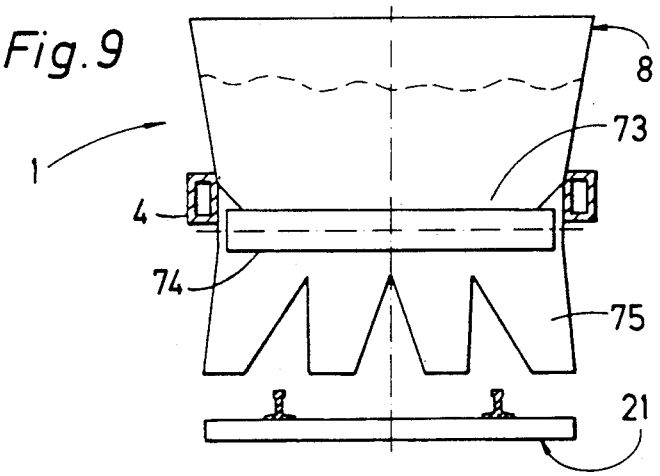
FIGS. 9 and 10 are schematic cross sections showing two variations of the ballast storage container of FIG. 8.

In the modification of machine 1 shown in FIGS. 8 and 9, the same reference numerals designate the same parts operating in the same manner as in FIGS. 1 and 2. According to the illustrated modification, the ballast storage container 8 has a single discharge opening 73 extending along a bottom portion of the container and a single conveyor band 74 is arranged immediately below the single discharge opening to close the opening. Thus, the discharge conveyor band operates simultaneously as the bottom conveyor of the storage container in the manner of conveyor 7. Four ballast distributing chutes 75 are arranged below the conveyor band discharge end for receiving ballast therefrom.

Furthermore, ballast discharge conveyor 77 extends in the longitudinal direction of elongated machine frame 4 and is arranged to receive ballast stored in container 8 and discharged at the conveyor band discharge end for unloading the storage container. The ballast discharge conveyor may be vertically adjusted from an upper rest position into a lowered operating position wherein it receives ballast from chutes 75.

Figure 10:
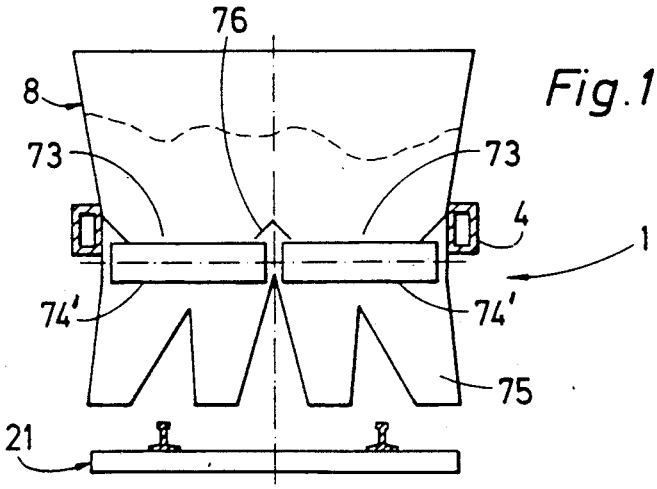

In the embodiment of FIG. 10, ballast storage container 8 also has a single discharge opening 73 extending along a bottom portion of the container but two conveyor bands 74', 74' are arranged immediately below the single discharge opening, the two conveyor bands extending substantially parallel to, and adjacent, each other. The two conveyor bands define a small gap therebetween, and cover element 76 extends over the gap whereby the two conveyor bands 74', 74' and cover element 76 close the opening. Each conveyor band has its own drive.

What is claimed is:

1. A machine for distributing and planing ballast supporting a railroad track comprising two rails fastened to ties, each rail having a gage side and a field side, which comprises (a) an elongated machine frame supported on the track by undercarriages for mobility along the track in an operating direction, (b) a ballast broom extending transversely across the track and mounted on the machine frame at a rear end thereof in the operating direction, (c) a ballast plow arrangement mounted on the machine frame, (d) a ballast storage container mounted on the machine frame and having at least one discharge opening enabling ballast stored in the container to be discharged onto the track, and (e) a ballast discharge conveyor band mounted immediately below each discharge opening and arranged to close the opening, each conveyor band having a drive for moving the conveyor band in a conveying direction.

2. The ballast distributing and planing machine of claim 1, wherein each conveyor band extends in the longitudinal direction of the elongated machine frame.

3. The ballast distributing and planing machine of claim 2, wherein the ballast storage container has four of said discharge openings and four of said ballast discharge conveyor bands mounted immediately below the discharge openings extend respectively along the gage and field sides of the two track rails, each conveyor band being pivotal about a vertical axis extending perpendicularly to the track, and further comprising a respective pivoting drive connected to each conveyor band.

4. The ballast distributing and planing machine of claim 3, wherein the vertical axes are substantially centered with respect to the respective ballast discharge openings wherebelow the pivotal conveyor bands are mounted.

5. The ballast distributing and planing machine of claim 2, wherein each conveyor band has substantially double the length of the discharge opening wherebelow it is mounted, measured in the longitudinal direction of the machine frame.

6. The ballast distributing and planing machine of claim 2, wherein each conveyor band has a ballast supporting surface facing the discharge opening wherebelow it is mounted, the ballast supporting surface having opposite sides extending in the longitudinal direction of the machine frame, and further comprising opposite ballast guide elements extending along the opposite sides of the ballast supporting conveyor band surface in the longitudinal direction of the machine frame, the ballast guide elements being arranged in V-formation to form a funnel leading from the discharge opening to the ballast supporting conveyor band surface and having upper edges extending parallel to the surface and above, and outwardly of, the discharge opening.

7. The ballast distributing and planing machine of claim 2, wherein each conveyor band has a discharge end, and further comprising a chute-like ballast distributing device arranged to receive ballast from the conveyor band discharge end, the ballast distributing device being pivotal about a horizontal axis extending transversely to the longitudinal direction of the elongated machine frame, and a drive connected to the pivotal ballast distributing device for vertically adjusting the device between an operating and a raised position.

8. The ballast distributing and planing machine of claim 7, wherein the chute-like ballast distributing device comprises elastic wiper elements at a lower end of the device, the wiper elements extending vertically in the operating position of the pivotal ballast distributing device and defining a section whose forward end is open in the operating direction.

9. The ballast distributing and planing machine of claim 8, wherein the elastic wiper elements have free lower ends extending substantially to the ties in the operating position of the pivotal ballast distributing device.

10. The ballast distributing and planing machine of claim 7, further comprising a baffle plate arranged between the conveyor band discharge end and an upper end of the chute-like ballast distributing device, the baffle plate defining an angle with the plane defined by the conveyor band.

11. The ballast distributing and planing machine of claim 2, wherein the ballast storage container has one of said discharge openings per rail and two of said ballast discharge conveyor bands are mounted immediately below the discharge openings, each conveyor band having a discharge end, and further comprising a chute-like ballast distributing device arranged to receive ballast from the conveyor band discharge end, the ballast distributing device having discharge openings extending respectively along the gage and field sides of the two track rails.

12. The ballast distributing and planing machine of claim 1, wherein a conveyor extends along a bottom portion of the ballast storage container and has a discharge end, each discharge opening being arranged below the conveyor discharge end for receiving ballast therefrom.

13. The ballast distributing and planing machine of claim 1, wherein the ballast storage container has a single one of the discharge openings extending along a bottom portion of the container and a single one of the conveyor bands is arranged immediately below the single discharge opening to close the opening.

14. The ballast distributing and planing machine of claim 13, wherein the single conveyor band has a discharge end, and further comprising ballast distributing chutes arranged below the conveyor band discharge end for receiving ballast therefrom.

15. The ballast distributing and planing machine of claim 1, wherein the ballast storage container has a single one of the discharge openings extending along a bottom portion of the container and two of the conveyor bands are arranged immediately below the single discharge opening, the two conveyor bands extending substantially parallel to, and adjacent each other, the two conveyor bands defining a small gap therebetween, and further comprising a cover element extending over the gap whereby the two conveyor bands and the cover element close the opening.

16. The ballast distributing and planing machine of claim 1, wherein the ballast storage container has a single one of the discharge openings along a bottom portion of the container and at least one of the conveyor bands is arranged immediately below the single discharge opening to close the opening, each conveyor band having a discharge end, and further comprising a ballast discharge conveyor extending in the longitudinal direction of the elongated machine frame and arranged to receive ballast stored in the container and discharged at the conveyor band discharge end for unloading the storage container.

* * * * *